US010448684B2

(12) United States Patent
Suddaby

(10) Patent No.: US 10,448,684 B2
(45) Date of Patent: Oct. 22, 2019

(54) PROTECTIVE HEAD SUPPORT ASSEMBLY

(71) Applicant: Loubert S. Suddaby, Orchard Park, NY (US)

(72) Inventor: Loubert S. Suddaby, Orchard Park, NY (US)

( * ) Notice: Subject to any disclaimer, the term of this patent is extended or adjusted under 35 U.S.C. 154(b) by 106 days.

(21) Appl. No.: 15/628,718

(22) Filed: Jun. 21, 2017

(65) Prior Publication Data

US 2018/0368490 A1 Dec. 27, 2018

(51) Int. Cl.

| | |
|---|---|
| ***A41D 13/015*** | (2006.01) |
| ***A41D 13/05*** | (2006.01) |
| ***A42B 3/04*** | (2006.01) |
| ***A63B 71/12*** | (2006.01) |
| *A41D 13/00* | (2006.01) |

(52) U.S. Cl.

CPC ..... *A41D 13/0512* (2013.01); *A42B 3/046* (2013.01); *A42B 3/0433* (2013.01); *A42B 3/0473* (2013.01); *A63B 71/1291* (2013.01)

(58) Field of Classification Search

CPC ..... A42B 3/0473; A42B 3/121; A42B 3/04; A42B 3/046; A42B 3/14; A42B 3/08; A42B 3/12; A42B 3/221; A42B 3/0453; A42B 3/067; A42B 3/0406; A42B 3/0433; B60R 2021/0048; B60R 2021/0206; B60R 21/02; A63B 71/1291; A63B 71/10; A63B 2220/40; A63B 71/12; A63B 2243/007; A63B 24/0062; A63B 2071/065; A63B 2220/58; A63B 2220/833; A63B 2220/836; A63B 2220/89; A63B 2225/50; A63B 2225/54; A41D 13/0512; A41D 13/015; A41D 13/0531; A41D 1/002

See application file for complete search history.

(56) References Cited

U.S. PATENT DOCUMENTS

| | | | | |
|---|---|---|---|---|
| 3,818,509 | A * | 6/1974 | Romo | A42B 3/0473 2/421 |
| 5,123,408 | A * | 6/1992 | Gaines | A42B 3/0473 2/425 |
| 6,006,368 | A * | 12/1999 | Phillips | A42B 3/0473 2/421 |
| 6,499,149 | B2 * | 12/2002 | Ashline | A42B 3/0473 2/411 |
| 6,696,973 | B1 * | 2/2004 | Ritter | G06F 1/163 340/10.1 |
| 6,701,529 | B1 * | 3/2004 | Rhoades | C08L 83/14 2/2.5 |

(Continued)

FOREIGN PATENT DOCUMENTS

WO WO03/015555 2/2003

OTHER PUBLICATIONS http://www.hovding.com/how_hovding_works, last accessed Aug. 17, 2017.

*Primary Examiner* — Robert H Muromoto, Jr.

(74) *Attorney, Agent, or Firm* — Simpson & Simpson, PLLC

(57) ABSTRACT

A protective head support assembly, including a helmet having one or more sensors, a vest, at least one stabilizer tube filled with a fluid, including a first end connected to the helmet, and a second end connected to the vest, and a transducer arranged to receive a signal from the one or more sensors and introduce a magnetic field to the fluid.

21 Claims, 7 Drawing Sheets

(56) References Cited

U.S. PATENT DOCUMENTS 6,813,782 B2 * 11/2004 Kintzi ..... A42B 3/0473 2/421
6,871,360 B1 * 3/2005 Ashline ..... B60R 22/001 2/411
6,931,669 B2 * 8/2005 Ashline ..... A42B 3/0473 2/422
6,968,576 B2 * 11/2005 McNeil ..... A42B 3/0473 2/425
D522,178 S * 5/2006 Ashline ..... D29/101.1
7,155,747 B2 * 1/2007 Baker ..... A42B 3/0473 2/421
7,380,290 B2 * 6/2008 Mothaffar ..... A42B 3/0473 2/421
7,395,558 B2 * 7/2008 Mothaffar ..... A42B 3/0473 2/421
7,430,767 B2 * 10/2008 Nagely ..... A42B 3/0473 2/425
7,765,623 B2 * 8/2010 Ashline ..... A42B 3/0473 2/421
7,789,844 B1 * 9/2010 Allen ..... A61F 5/373 602/19
7,849,525 B2 * 12/2010 Ghajar ..... A42B 3/046 2/410
7,941,873 B2 * 5/2011 Nagely ..... A42B 3/0473 2/425
8,015,626 B2 * 9/2011 Grassl ..... A42B 3/04 2/410
8,074,301 B2 * 12/2011 Mothaffar ..... A41D 13/0512 2/411
8,181,281 B2 * 5/2012 Nagely ..... A42B 3/0473 2/425
8,272,074 B1 * 9/2012 Ashline ..... A42B 3/0473 2/421
8,341,770 B2 * 1/2013 Siegler ..... A42B 3/0473 2/410
8,375,472 B2 * 2/2013 Ashline ..... A42B 3/0473 2/421
8,384,777 B2 * 2/2013 Maguire, Jr. ..... G06F 3/011 345/8
8,443,468 B2 * 5/2013 Minson ..... A42B 3/0473 2/468
9,665,983 B2 * 5/2017 Spivack ..... G06Q 30/0643
9,795,178 B2 * 10/2017 Suddaby ..... A42B 3/124
9,980,531 B2 * 5/2018 Suddaby ..... A42B 3/064
2004/0131498 A1 * 7/2004 Kuutti ..... G08B 21/02 359/16
2004/0255368 A1 * 12/2004 Baker ..... A42B 3/0473 2/410
2006/0074338 A1 * 4/2006 Greenwald ..... A61B 5/0002 600/549
2007/0022520 A1 * 2/2007 Grassl ..... A42B 3/04 2/424
2007/0186329 A1 * 8/2007 Baker ..... A42B 3/0473 2/410
2007/0245464 A1 * 10/2007 Baker ..... A42B 3/0473 2/411
2009/0064396 A1 * 3/2009 Ghajar ..... A42B 3/0473 2/411
2010/0223706 A1 * 9/2010 Becker ..... A42B 3/30 2/8.2
2013/0019384 A1 * 1/2013 Knight ..... A42B 3/064 2/411
2013/0019385 A1 * 1/2013 Knight ..... A42B 3/064 2/411
2013/0086734 A1 * 4/2013 Siegler ..... A42B 3/0473 2/468
2013/0130843 A1 * 5/2013 Burroughs ..... A63B 71/0686 473/415
2013/0232668 A1 * 9/2013 Suddaby ..... A42B 3/064 2/413
2013/0296755 A1 * 11/2013 Duncan ..... A61F 5/05883 602/18
2014/0173810 A1 * 6/2014 Suddaby ..... A42B 3/124 2/413
2015/0143617 A1 * 5/2015 Suddaby ..... A42B 3/064 2/414
2015/0154452 A1 * 6/2015 Bentley ..... G06K 9/00711 386/201
2015/0173666 A1 * 6/2015 Smith ..... A61B 5/11 600/301
2016/0366969 A1 * 12/2016 Suddaby ..... A42B 3/064
2017/0112220 A1 * 4/2017 Suddaby ..... A42B 3/064
2017/0251744 A1 * 9/2017 Suddaby ..... A42B 3/124
2018/0160760 A1 * 6/2018 Suddaby ..... A42B 3/065
2018/0190027 A1 * 7/2018 Yao ..... G06F 3/011
2018/0368490 A1 * 12/2018 Suddaby ..... A41D 13/0512

* cited by examiner

PROTECTIVE HEAD SUPPORT ASSEMBLY

FIELD

The present invention relates to personal protective equipment, and, more particularly, to a protective head support assembly to prevent neck injury in contact sports.

BACKGROUND

Neck injury from sudden acceleration or deceleration force is extremely common. The term "whiplash" was initially coined in 1928 and describes damage to both bone and soft tissue in the neck when the head and body are accelerated, each from the other, causing severe hyperflexion, hyperextension, or lateral bending of the cervical spine. While whiplash injury is most commonly seen in motor vehicle accidents, contact sports are also a frequent cause of such injuries. Many contact sports require the use of protective headgear, which has been implicated as a cause of increased neck injury because of the increase in mass or weight of the head when protective headgear is worn. While rarely lethal, whiplash injuries result in substantial morbidity and economic loss.

While much has been done to design protective headgear in professional sport, little has been done to prevent concomitant neck injury which occurs with similar frequency. Indeed, because of the increased weight of protective head gear, many have speculated that the wearing of a helmet may actually increase the risk of neck injury in both athletic and motor sports. Clearly, there is a need to protect not only the head but also the neck in any contact sport or other sporting endeavors where helmet wearing is a must.

SUMMARY

According to aspects illustrated herein, there is provided a protective head support assembly, comprising a helmet comprising one or more sensors, a vest, at least one stabilizer tube filled with a fluid, including a first end connected to the helmet, and a second end connected to the vest, and a transducer arranged to receive a signal from the one or more sensors and introduce a magnetic field to the fluid.

According to aspects illustrated herein, there is provided a protective head support assembly, comprising a helmet including one or more sensors, a vest, at least one stabilizer tube filled with a fluid, including a first end connected to the helmet, and a second end connected to the vest, an impact element arranged proximate the at least one stabilizer tube, the impact element operatively arranged to provide a concussive force to the at least one stabilizer tube, and a transducer arranged to receive a signal from the at least one sensor and transmit a signal to the impact element.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials, and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices, or materials similar or equivalent to those described herein can be used in the practice or testing of the example embodiments. The assembly of the present disclosure could be driven by hydraulics, electronics, and/or pneumatics.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

Figure 1:
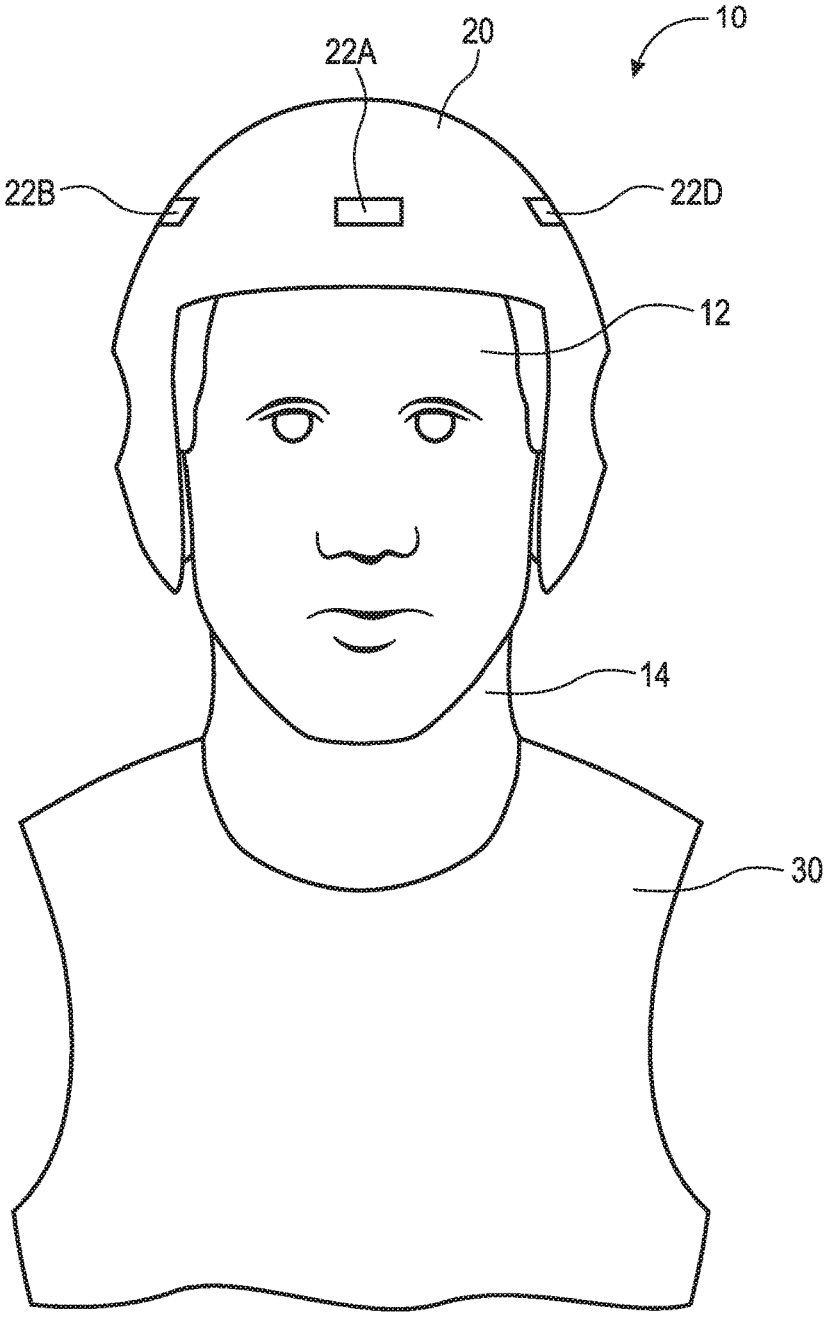
FIG. 1 is a front elevational view of a protective head support assembly.
Figure 2:
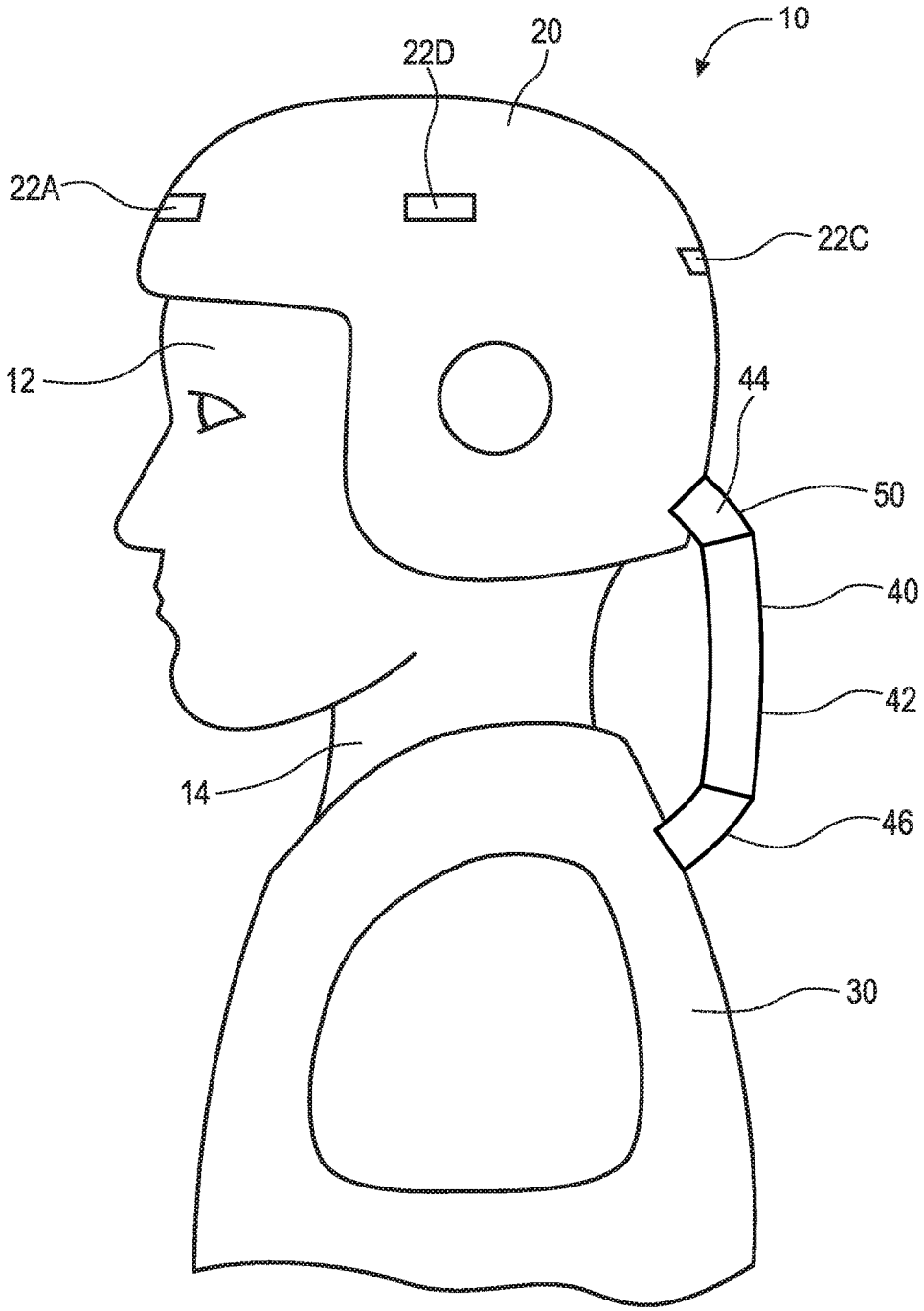
FIG. 2 is a side elevational view of the protective head support assembly shown in FIG. 1.
Figure 3:
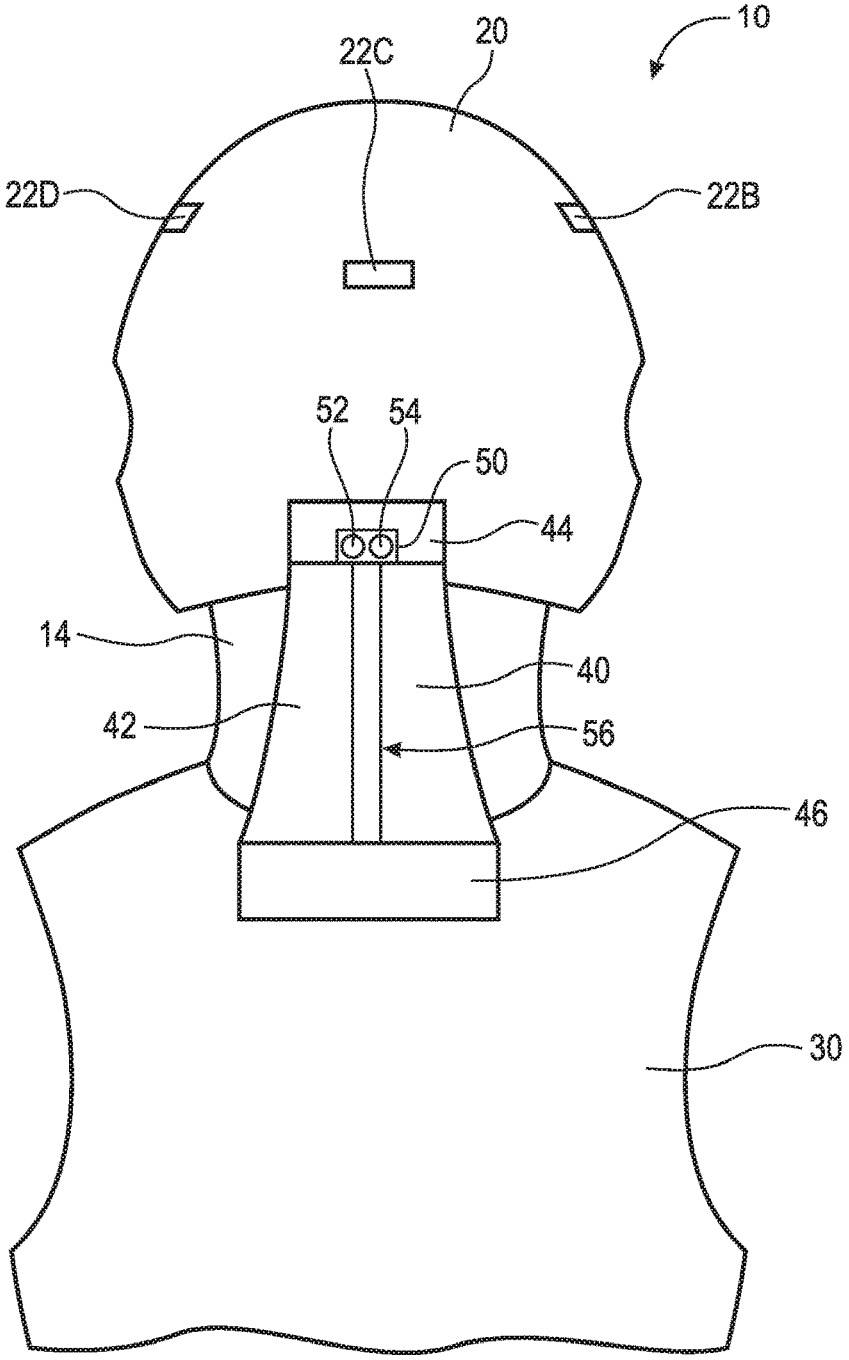
FIG. 3 is a rear elevational view of the protective head support assembly shown in FIG. 1.

Referring now to the figures, FIG. 1 is a front elevational view of protective head support assembly 10. FIG. 2 is a side elevational view of protective head support assembly 10. FIG. 3 is a rear elevational view of protective head support assembly 10. Protective head support assembly 10 generally comprises helmet 20, vest 30, and stabilizer 40.

Helmet 20 is a hard or padded protective hat, various types of which are worn by soldiers, police officers, firefighters, motorcyclists, athletes, and others. Helmet 20 is fitted over a user's head 12. Helmet 20 comprises one or more sensors 22A-D. Sensors 22A-D are any sensors capable of detecting an incoming impact and transmitting a signal to transducer 50, as will be discussed in greater detail below. Sensors 22A-D may be, for example, active Light Detection and Ranging (LIDAR) sensors, Radio Detection and Ranging (RADAR) distance sensors, motion detectors, proximity sensors, passive infrared sensors, alarm sensors, or any other suitable optical, light, imaging, photon, proximity, or presence sensor. In the embodiment shown, helmet 20 comprises four sensors 22A-D. However, it should be appreciated that any number of sensors suitable for detecting incoming impact from any position. In an example embodiments, sensors 22A-D are located on vest 30. It should be appreciated that sensors 22A-D can be located at any location of a user's body suitable for detecting incoming contact.

Vest (or shoulder pads) 30 is a piece of protective equipment used in many contact sports such as American football, Canadian football, lacrosse, and hockey. With respect to the present disclosure, vest 30 is any garment that is securely worn on the upper torso of a user. It should be appreciated that vest 30 does not actually need to be a vest, but rather may be a shirt and comprise sleeves. It should also be appreciated that vest 30 does not need to be a protective piece of equipment.

Stabilizer 40 comprises wall 42, base 44, base 46, fluid 48, and transducer 50. Stabilizer 40 is generally an elliptical tube having wall 42 filled with fluid 48 that extends between helmet 20 and vest 30 along neck 14 of a user. It should be appreciated that stabilizer 40 can be any shape suitable to stiffen and promote alignment of head 12 and neck 14. For example, stabilizer 40 may be a frusto-conical tube, a rectangular tube, a square tube, a circular tube, or a triangular tube. Because of its positioning, stabilizer 40 does not interfere with the user's vision. Stabilizer 40 is sealed at a top end by base 44 and at a bottom end by base 46. Stabilizer 40 is secured to helmet 20 at base 44 and vest 30 at base 46. Wall 42 is made of a material that can be suitably stiffened, such as a substantially non-elastic rubber. In the embodiment shown, protective head support assembly 10 comprises one stabilizer tube. In an example embodiment, protective head support assembly 10 comprises two stabilizer tubes. In an example embodiment, protective head support assembly 10 comprises a plurality of stabilizer tubes. However, it should be appreciated that protective head support assembly 10 may comprise any number of stabilizer suitable to stiffen and support the user's neck.

Transducer 50 is arranged to receive a signal from any of sensors 22A-D and transmit a magnetic field proximate fluid 48, as will be discussed in greater detail below. As is known in the art, a magnetic field is created as an effect of electric current. In the embodiment shown, transducer 50 is arranged adjacent stabilizer 40 in base 44 and comprises receiver 52, power source 54, and conductor 56. In an example embodiment, transducer 50 is arranged in base 46. It should be appreciated that transducer 50 can be located at any position suitable to detect a signal and transmit an electric current proximate stabilizer 40. For example, transducer 50 may be located as a transducer pack on a user's waist belt and have an electrical conductor, such as a wire, connected to stabilizer 40. Transducer 50 is capable of transmitting a variable amount of electric current through conductor 56, thereby creating a variable strength magnetic field proximate fluid 48. For example, if sensor 22B determines, based on the velocity and mass of the incoming object, that a very large collision is about to occur, then transducer 50 will transmit a large amount of current though conductor 56 and thus large magnetic field proximate fluid 48 such that stabilizer 40 is stiffer. On the other hand, if sensor 22B determines, based on the velocity and mass of the incoming object, that a small to moderate collision is about to occur, then transducer 50 will only transmit a small amount of current through conductor 56 and thus small magnetic field proximate fluid 48 such that the user is protected but head 12 and neck 14 are not overly inhibited. The amount of electric current transmitted based on velocity and mass of the incoming object can be calibrated. Conductor 56 is arranged proximate stabilizer 40 and may be any suitable material or shape for conducting electricity and creating a magnetic field (e.g., a copper wire or rod). In an example embodiment, conductor 56 runs through fluid 48 within stabilizer 40. In an example embodiment, conductor 56 is arranged outside of stabilizer 40 adjacent to wall 42. In addition, conductor 56 may be a set of two or more wires or rods (i.e., a lead conductor and a return conductor). Power source 54 is any electronic device that supplies electric energy to an electric load, for example, a lead-acid or lithium-ion battery. Power source 54 may also be located in vest 30 or in another suitable location, such as a waste pack for example.

Figure 4A:
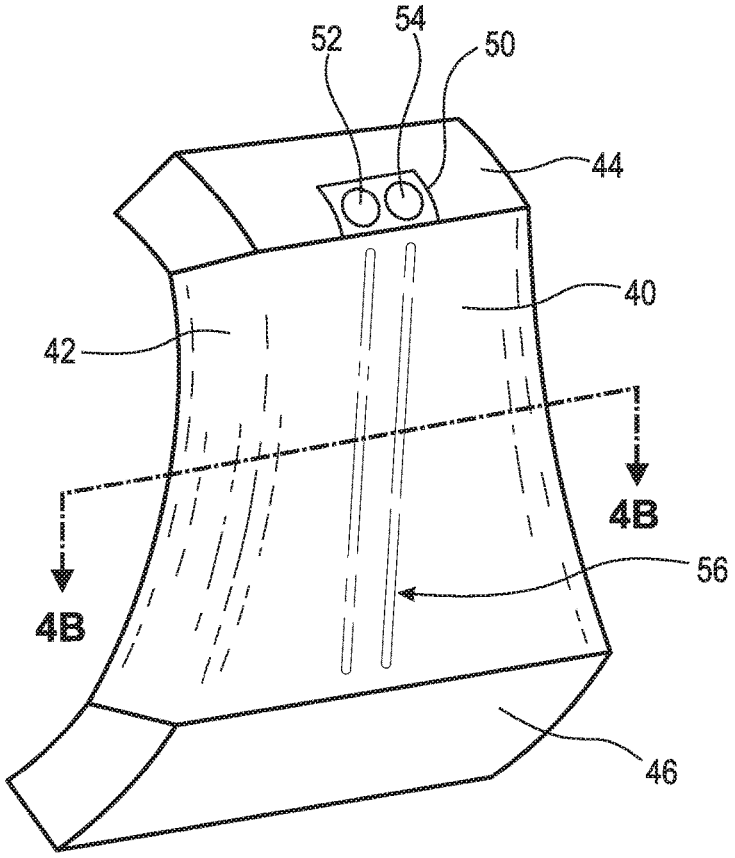
FIG. 4A is a rear perspective view of the stabilizer shown in FIG. 3.
Figure 4B:
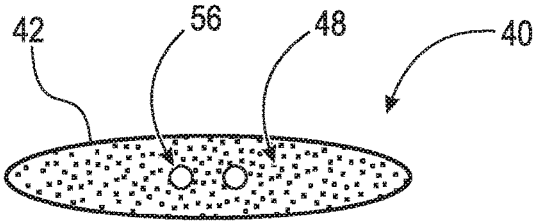
FIG. 4B is a cross-sectional view of the stabilizer shown in FIG. 4A, taken generally along line 4B-4B.

FIG. 4A is a rear perspective view of stabilizer 40. FIG. 4B is a cross-sectional view of stabilizer 40, taken generally along line 4B-4B in FIG. 4A. Stabilizer 40 is filled with fluid 48. In one embodiment fluid 48 is preferably a magnetorheological fluid (MR fluid). A MR fluid is a type of smart fluid in a carrier fluid, usually a type of oil. When subjected to a magnetic field, the fluid greatly increases its apparent viscosity, to the point of becoming a viscoelastic solid. Importantly, the yield stress of the fluid when in its active ("on") state can be controlled very accurately by varying the magnetic field intensity. The upshot is that the fluid's ability to transmit force can be controlled with an electromagnet, which gives rise to its many possible control-based applications. In another embodiment, fluid 48 is a ferrofluid. MR fluid is different from a ferrofluid, which has smaller particles. MR fluid particles are primarily on the micrometer-scale and are too dense for Brownian motion to keep them suspended (in the lower density carrier fluid). Ferrofluid particles are primarily nanoparticles (i.e., nanometer-scale) that are suspended by Brownian motion and generally will not settle under normal conditions. It should be appreciated that any other suitable fluid that stiffens once an electric current is introduced therein may be used. Additionally, and as discussed above, the amount of current introduced through conductor 56 is directly related to the strength of the magnetic field proximate fluid 48, and controls the amount of stiffening of stabilizer 40. For example, as the current introduced through conductor 56 and the magnetic field proximate fluid 48 increases, the stiffer stabilizer 40 gets. This is useful, for example, if a larger impact is about to occur and increased protection is required. It should be appreciated that vest 30 may also contain a MR fluid or a ferrofluid or any other fluid that stiffens when a magnetic field is applied proximate thereto.

Figure 5B:
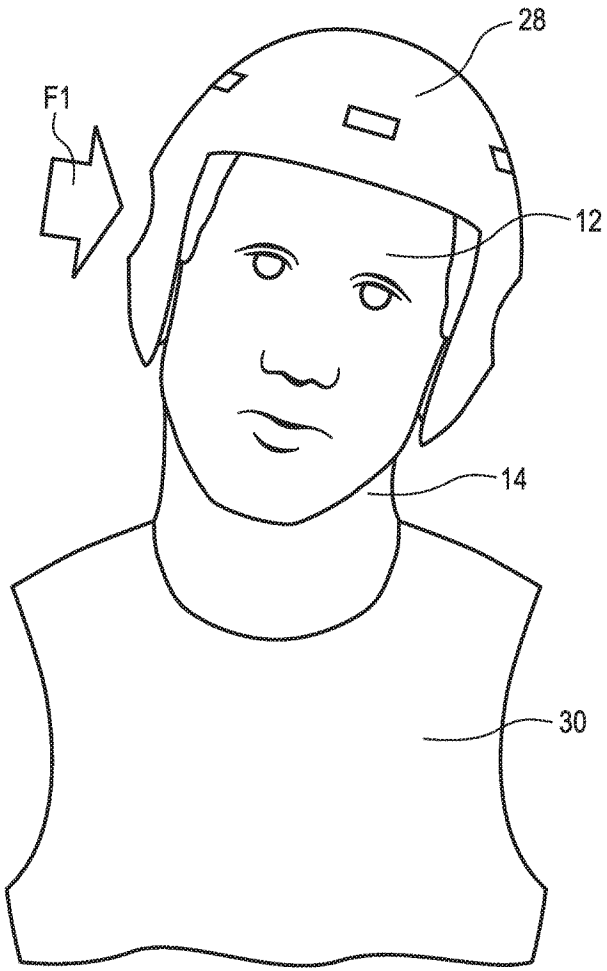
FIG. 5B is a front elevational view of a the normal helmet assembly shown in FIG. 5A after impact.
Figure 5A:
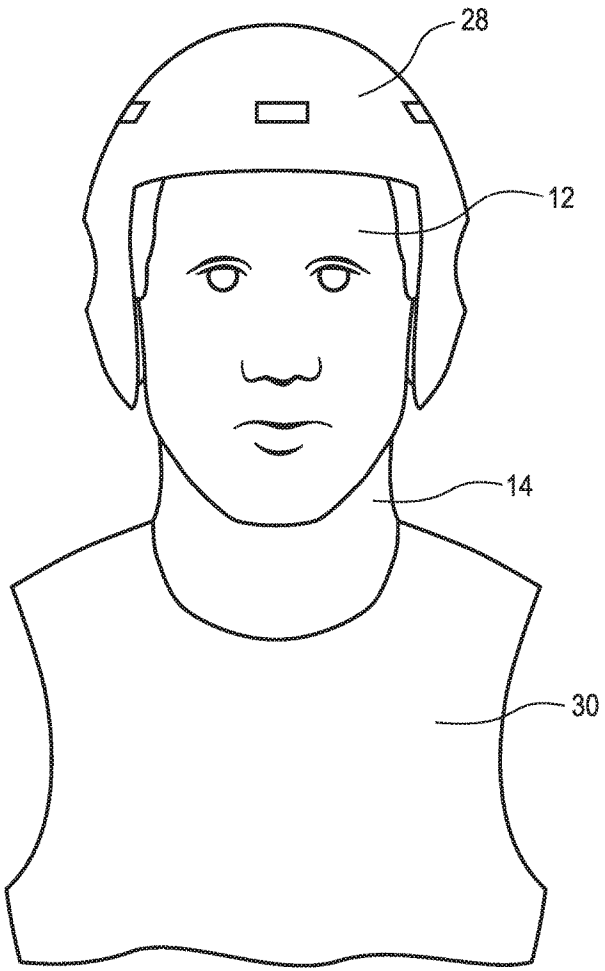
FIG. 5A is a front elevational view of a normal helmet assembly before impact.

FIG. 5A is a front elevational view of a user wearing helmet 28 and vest 20 before an impact. Helmet 28 is a normal helmet with no sensors. The user does not have stabilizer 40 extending between helmet 28 and vest 20. FIG. 5B is a front elevational view of the normal helmet assembly shown in FIG. 5A after impact. As shown in FIG. 5B, force F1 hits helmet 28, and the user's head 12 and neck 14 are displaced such that they are forced away from the impact of force F1. Such an impact and displacement of head 12 and neck 14 can cause serious injury. Stabilizer 40 of protective head support assembly 10 prevents this displacement and thus the serious injuries that accompany such impacts.

Figure 6:
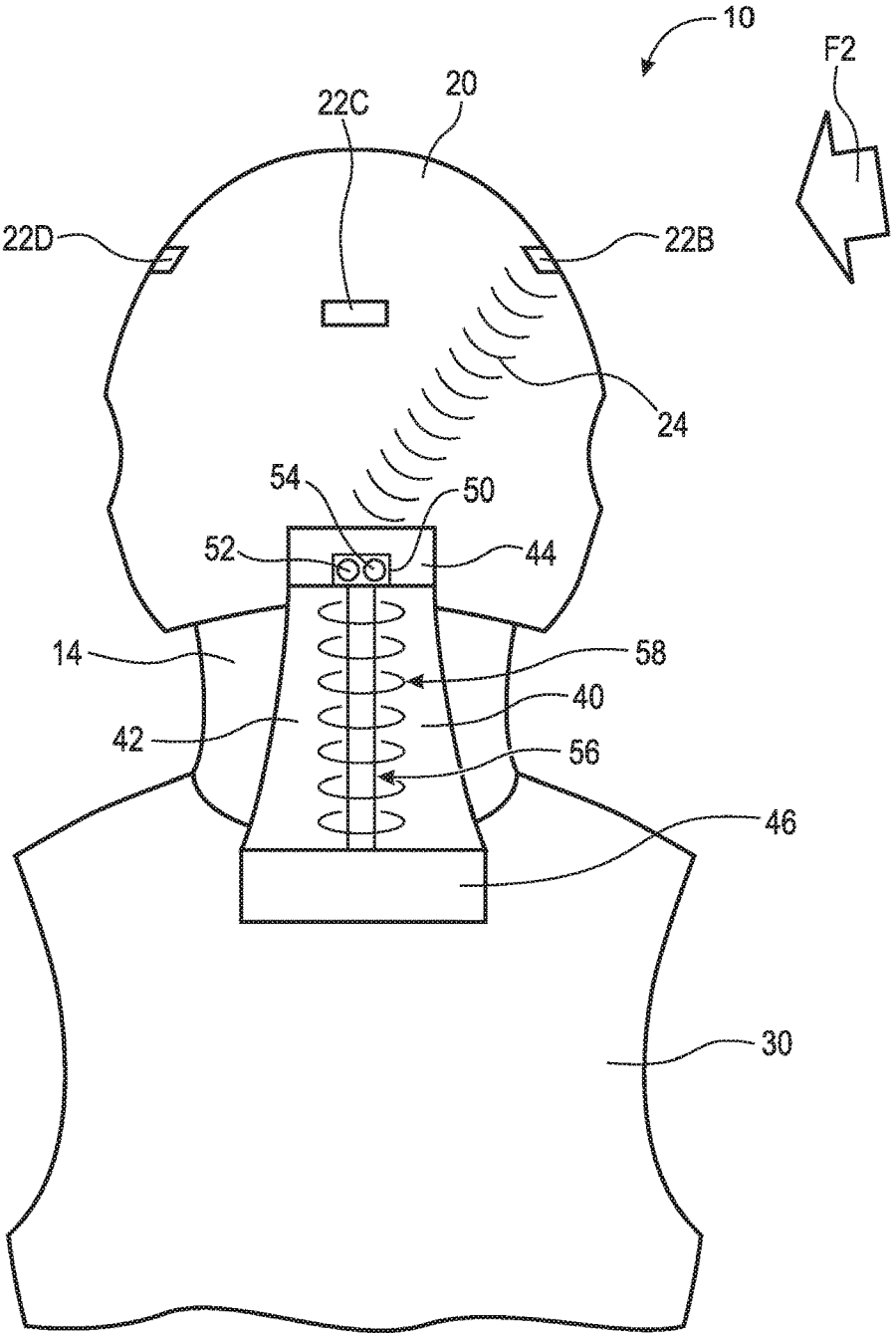
FIG. 6 is a rear elevational view of the protective head support assembly shown in FIG. 1 before impact; and, FIG. 7 is a side elevational view of a protective head support assembly.

FIG. 6 is a rear elevational view of protective head support assembly 10 before impact. As shown, an impact represented by force F2 is incoming from the right side of helmet 20. Sensor 22B detects force F2 and sends signal 24 to transducer 50. Receiver 52 of transducer 50 receives signal 24. Using power source 54, transducer 50 then sends an electric current through conductor 56, which creates magnetic field 58 proximate fluid 48 and stabilizer 40. Magnetic field 58 stiffens fluid 48 and stabilizer 40 prior to impact and thus prevents head 12 and neck 14 from displacing as illustrated in FIGS. 5A and 5B. It should be appreciated that, when no impact is imminent, and an electric current is not being transmitted through conductor 56, stabilizer 40 is generally flaccid. In the flaccid state, stabilizer 40 does not substantially inhibit movement of head 12 or neck 14. However, when one of sensors 22A-D senses that contact will occur, it sends signal 24 to transducer 50, which sends electric current through conductor 56, creates magnetic field 58 proximate fluid 48, and stiffens stabilizer 40.

Figure 7:
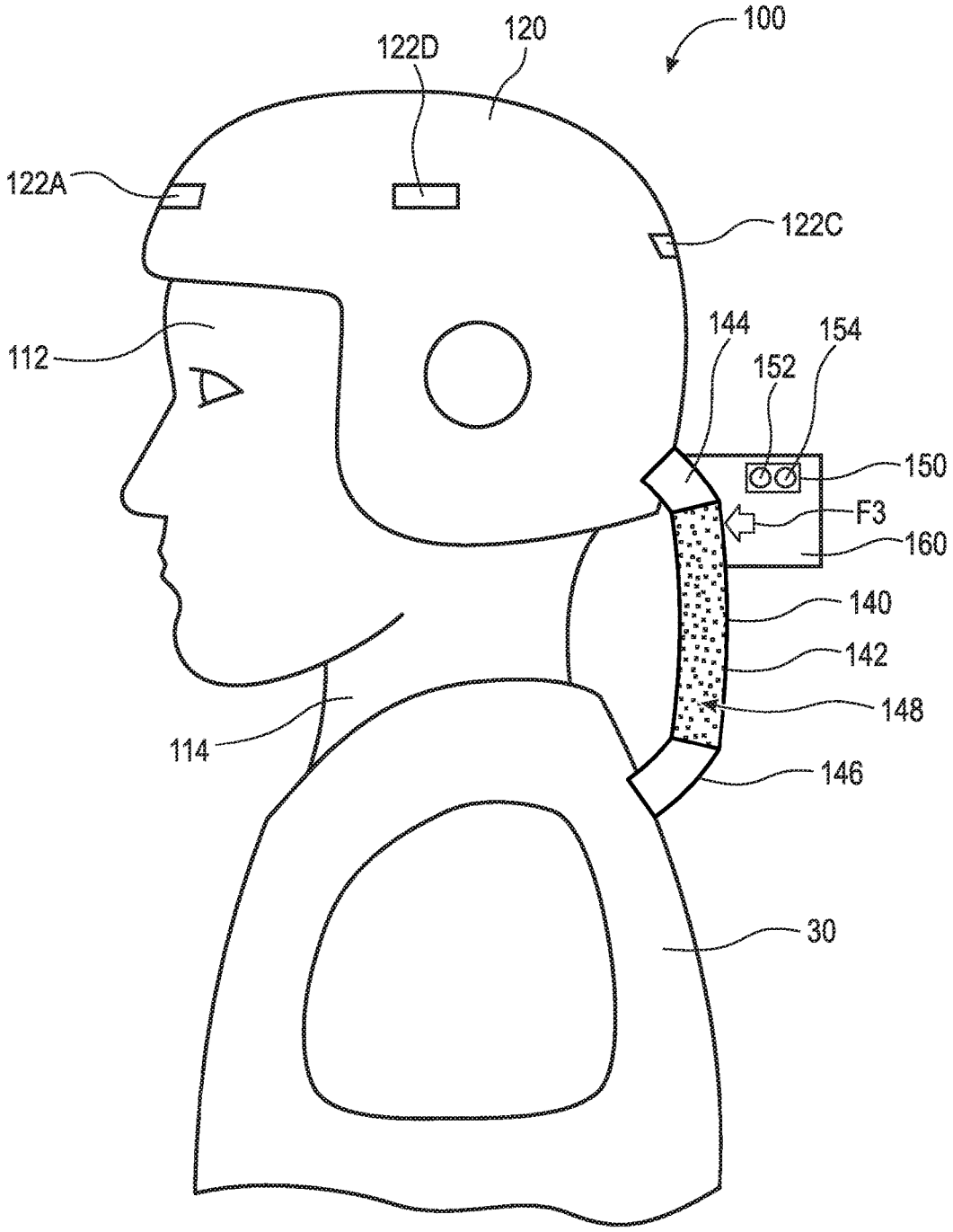

FIG. 7 is a side elevational view of protective head support assembly 100. Protective head support assembly 100 comprises helmet 120, vest 130, stabilizer 140, and impact element 160. Protective head support assembly 100 is substantially similar to protective head support assembly 10.

Helmet 120 is a hard or padded protective hat, various types of which are worn by soldiers, police officers, firefighters, motorcyclists, athletes, and others. Helmet 120 is fitted over a user's head 112. Helmet 120 comprises one or more sensors 122A-D. Sensors 122A-D are any sensors capable of detecting an incoming impact and transmitting a signal to transducer 150, as will be discussed in greater detail below. Sensors 122A-D may be, for example, active LIDAR sensors, RADAR distance sensors, motion detectors, proximity sensors, passive infrared sensors, alarm sensors, or any other suitable optical, light, imaging, photon, proximity, or presence sensor. In the embodiment shown, helmet 120 comprises four sensors 122A-D. However, it should be appreciated that any number of sensors suitable for detecting incoming impact from any position. In an example embodiments, sensors 122A-D are located on vest 130. It should be appreciated that sensors 122A-D can be located at any location of a user's body suitable for detecting incoming contact.

Vest (or shoulder pads) 130 is a piece of protective equipment used in many contact sports such as American football, Canadian football, lacrosse, and hockey. With respect to the present disclosure, vest 130 is any garment that is securely worn on the upper torso of a user. It should be appreciated that vest 130 does not actually need to be a vest, but rather may be a shirt and comprise sleeves. It should also be appreciated that vest 130 does not need to be a protective piece of equipment.

Stabilizer 140 comprises wall 142, base 144, base 146, fluid 148, and transducer 150. Stabilizer 140 is generally an elliptical tube having wall 142 filled with fluid 148 that extends between helmet 120 and vest 130 along neck 114 of a user. It should be appreciated that stabilizer 140 can be any shape suitable to stiffen and promote alignment of head 112 and neck 114. For example, stabilizer 140 may be a frustoconical tube, a rectangular tube, a square tube, a circular tube, or a triangular tube, or indeed, multiple tubes. Because of its positioning, stabilizer 140 does not interfere with the user's vision. Stabilizer 140 is sealed at a top end by base 144 and at a bottom end by base 146. Stabilizer 140 is secured to helmet 120 at base 144 and vest 130 at base 146. Wall 142 is made of a material that can be suitably stiffened, such as a substantially non-elastic rubber. Stabilizer 140 is filled with fluid 148. Fluid 148 is a non-Newtonian fluid or any other fluid that stiffens once an impact force has been applied thereto. It should also be appreciated that vest 130 may also contain non-Newtonian fluid or any other fluid that stiffens once an impact force has been applied thereto. In the embodiment shown, protective head support assembly 100 comprises one stabilizer tube. In an example embodiment, protective head support assembly 100 comprises two stabilizer tubes. In an example embodiment, protective head support assembly 100 comprises a plurality of stabilizer tubes. However, it should be appreciated that protective head support assembly 100 may comprise any number of stabilizer suitable to stiffen and support the user's neck.

Transducer 150 is arranged to receive a signal from sensors 122A-D and transmit a force to stabilizer 140, as will be discussed in greater detail below. In the embodiment shown, transducer 150 is arranged adjacent stabilizer 140 in impact element 160 and comprises receiver 152 and power source 154. It should be appreciated that transducer 150 can be located at any position suitable to detect a signal and transmit an electric current to stabilizer 140. For example, transducer 150 may be located as a transducer pack on a user's waist belt and have an electrical conductor, such as a wire, connected to impact element 160. Impact element 160 is any device capable of introducing a concussive impact to stabilizer 140. For example, impact element 160 can be a hammer or other mechanical device, or an air gun or other pneumatic force providing mechanism.

Similar to protective head support assembly 10, when one of sensors 122A-D detects an incoming impact they transmit signal 126 (not shown) to transducer 150. Receiver 152 of transducer 150 receives the signal, and transducer 150, using power source 154, transmits a signal to impact element 160. Impact element 160 then provides concussive force F3 to impact stabilizer 140. Force F3 causes fluid 148 to stiffen within stabilizer 140 and causes head 112 and neck 114 to remain substantially aligned. The use of non-Newtonian fluid requires that a separate concussive force be applied to stabilizer 140 in order to stiffen the fluid therein. This separate concussive force must be applied prior to the incoming impact in order to protect the user.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

10 Protective head support assembly
12 Head
14 Neck
20 Helmet
22A Sensor
22B Sensor
22C Sensor
22D Sensor
24 Signal
28 Helmet
30 Vest
40 Stabilizer
42 Wall
44 Base
46 Base
48 Fluid
50 Transducer
52 Receiver
54 Power source

56 Conductor
58 Magnetic field
100 Protective head support assembly
120 Helmet
122A Sensor
122B Sensor (not shown)
122C Sensor
122D Sensor
124 Signal (not shown)
130 Vest
140 Stabilizer
142 Wall
144 Base
146 Base
148 Fluid
150 Transducer
152 Receiver
154 Power source
160 Impact element
F1 Force
F2 Force
F3 Force

What is claimed is:

1. A protective head support assembly, comprising:
a helmet comprising one or more sensors;
a vest;
at least one stabilizer tube filled with a fluid, including:
a first end connected to the helmet; and,
a second end connected to the vest;
a transducer operatively arranged to receive a signal from the one or more sensors and introduce a magnetic field to the fluid; and,
a conductor electrically connected to the transducer and arranged at least partially within the fluid, wherein the transducer is operatively arranged to sends an electrical current through the conductor to introduce the magnetic field to the fluid.

2. The protective head support assembly as recited in claim 1, wherein when the magnetic field is introduced to the fluid the at least one stabilizer tube stiffens.

3. The protective head support assembly as recited in claim 2, wherein the fluid is a magneto-rheologic fluid.

4. The protective head support assembly as recited in claim 2, wherein the fluid is a ferrofluid.

5. The protective head support assembly as recited in claim 2, wherein the transducer comprises:
a receiver;
a power source; and,
a transmitter.

6. The protective head support assembly as recited in claim 2, wherein the one or more sensors are Light Detection and Ranging sensors.

7. The protective head support assembly as recited in claim 2, wherein the one or more sensors are Radio Detection and Ranging distance sensors.

8. The protective head support assembly as recited in claim 2, wherein:
the first end of the at least one stabilizer tube is sealed by a first base, the first base being secured to the helmet; and,
the second end of the at least one stabilizer tube is sealed by a second base, the second base being secured to the vest.

9. The protective head support assembly as recited in claim 8, wherein the transducer is arranged in the first base.

10. The protective head support assembly as recited in claim 8, wherein the transducer is arranged in the second base.

11. A protective head support assembly, comprising:
a helmet including one or more sensors;
a vest;
at least one stabilizer tube filled with a fluid, including:
a first end connected to the helmet; and,
a second end connected to the vest;
an impact element arranged proximate the at least one stabilizer tube, the impact element operatively arranged to provide a concussive force to the at least one stabilizer tube; and,
a transducer arranged to receive a signal from the at least one sensor and transmit a signal to the impact element.

12. The protective head support assembly as recited in claim 11, wherein when the concussive force is introduced to the at least one stabilizer tube, the fluid and the at least one stabilizer tube stiffen.

13. The protective head support assembly as recited in claim 12, wherein the fluid is a non-Newtonian fluid.

14. The protective head support assembly as recited in claim 12, wherein the transducer comprises:
a receiver;
a power source; and,
a transmitter.

15. The protective head support assembly as recited in claim 12, wherein the at least one sensor is a Light Detection and Ranging sensor.

16. The protective head support assembly as recited in claim 12, wherein the at least one sensor is a Radio Detection and Ranging distance sensor.

17. The protective head support assembly as recited in claim 12, wherein:
the first end of the at least one stabilizer tube is sealed by a first base, the first base being secured to the helmet; and,
the second end of the at least one stabilizer tube is sealed by a second base, the second base being secured to the vest.

18. The protective head support assembly as recited in claim 17, wherein the transducer is arranged in the first base.

19. The protective head support assembly as recited in claim 17, wherein the transducer is arranged in the second base.

20. The protective head support assembly as recited in claim 17, wherein the transducer is arranged in the impact element.

21. The protective head support assembly as recited in claim 1, wherein the at least one stabilizer tube further comprises a wall including rubber.

* * * * *